US007981170B1

(12) United States Patent
Lieder et al.

(10) Patent No.: US 7,981,170 B1
(45) Date of Patent: Jul. 19, 2011

(54) GASOLINE-OXYGENATE BLEND AND METHOD OF PRODUCING THE SAME

(75) Inventors: Charles Arthur Lieder, Houston, TX (US); Lloyd Elbert Funk, Florissant, MO (US); David Allen Barker, Houston, TX (US)

(73) Assignee: Shell Oil Company, Houston, TX (US)

( * ) Notice: Subject to any disclaimer, the term of this patent is extended or adjusted under 35 U.S.C. 154(b) by 1625 days.

(21) Appl. No.: 09/556,852

(22) Filed: Apr. 21, 2000

(51) Int. Cl.
*C10L 1/18* (2006.01)

(52) U.S. Cl. ..... 44/451; 44/452

(58) Field of Classification Search ..... 44/436, 44/451, 452

See application file for complete search history.

(56) References Cited

U.S. PATENT DOCUMENTS

| | | | | |
|---|---|---|---|---|
| 4,207,076 | A | 6/1980 | Bove et al. | 44/56 |
| 4,207,077 | A | 6/1980 | Bove et al. | 44/56 |
| 4,282,008 | A | 8/1981 | Sung | 44/53 |
| 4,282,088 | A | 8/1981 | Ennis | 209/17 |
| 4,297,172 | A | 10/1981 | Kyle | 203/19 |
| 4,317,657 | A * | 3/1982 | Niebylski | 44/360 |
| 4,328,004 | A | 5/1982 | Globus | 44/56 |
| 4,479,807 | A | 10/1984 | Rebandt | 44/56 |
| 4,541,836 | A | 9/1985 | Derderian | 44/53 |
| 4,599,088 | A | 7/1986 | Davis et al. | 44/51 |
| 4,695,292 | A | 9/1987 | Osborg | 44/64 |
| 5,288,393 | A | 2/1994 | Jessup et al. | 208/16 |
| 5,551,957 | A * | 9/1996 | Cunningham et al. | 44/359 |
| 5,593,567 | A | 1/1997 | Jessup et al. | 208/46 |
| 5,653,866 | A | 8/1997 | Jessup et al. | 208/46 |
| 5,679,116 | A * | 10/1997 | Cunningham et al. | 44/359 |
| 5,679,117 | A | 10/1997 | Jarvis et al. | 44/451 |
| 5,697,987 | A * | 12/1997 | Paul | 44/352 |
| 5,837,126 | A | 11/1998 | Jessup et al. | 208/16 |
| 6,030,521 | A | 2/2000 | Jessup et al. | 208/17 |
| 6,039,772 | A * | 3/2000 | Orr | 44/350 |
| 6,048,373 | A * | 4/2000 | Malfer et al. | 44/415 |
| RE37,089 | E | 3/2001 | Jarvis et al. | 44/451 |
| 6,290,734 | B1 | 9/2001 | Scott et al. | |
| 6,328,772 | B1 * | 12/2001 | Scott et al. | 44/451 |

FOREIGN PATENT DOCUMENTS

| | | |
|---|---|---|
| WO | WO/89/05339 | 6/1989 |

OTHER PUBLICATIONS

American Society for Testing and Materials; Standard Specification for Automotive Spark-Ignition Engine Fuel; Designation D 4814-98 Aug. 1998; 23 pages.

Evans, M.K.; "The Economic Impact of the Demand for Ethanol"; Midwestern Governor's Conference; http://www.ethanolrfa.org/docs/evans.html; Feb. 1977; 15 pages.

Whitten, G.Z.; Cohen, J.P., Kuklin, A.M., and Systems Applications International, Inc.; "Regression Modeling of Oxyfuel Effects on Ambient CO Concentrations"; Renewable Fuels Association and Oxygenated Fuels Association; http://www.ethanolrfa.org/967810.htrnl; Jan. 1997; 18 pages.

(Continued)

*Primary Examiner* — Cephia D Toomer

(57) ABSTRACT

By controlling one or more properties of a gasoline-oxygenate blend, a gasoline-oxygenate blend may be blended to contain at least one alcohol that exhibits acceptable properties and characteristics. This blend and the preferred method of preparing this blend includes an alcohol, most preferably ethanol, to reduce or eliminate the introduction of MTBE while offering acceptable properties such as volatility and temperature while effectively reducing pollutant emissions.

10 Claims, 1 Drawing Sheet

OTHER PUBLICATIONS

Shapouri, H. Duffield, J.A. and GraboskI,J.S.; "Estimating the Net Energy Balance of Corn Ethanol"; U.S. Department of Agriculture, Economic Research Service, Office of Energy, Agricutural Economic Reportr No. 721; .Jul. 1995; 18 pages.

Downstream Alternative, Inc.; "The Use of Ethanol in California Clean Burning Gasoline—Ethanol Supply/Demand and Logistics"; The Renvewal Fuels Association; Feb. 1999; 50 pages.

Whitten, Ph.D., G.; "Air Quality Impacts of Ethanol in California Gasoline"; Systems Applications International, Inc.; http:ethanolrfa.org/white991.html; 5 pages.

Armstrong, M.S., M.S., Sarah R.; "Ethanol"; Cambridge Environmental, Inc.; http://www.ethanolrfa.org/544_er_1999. html; Mar. 1999; 6 pages.

Downstream Alternatives Inc.; "RFG/MTBE Issues and Options in the Northeast"; Northest States for Coordinated Air Use Management (NESCAUM); May 1999; 29 pages.

Redacted Gasoline Data from Third Party Source, Jun. 1992, 1 page.

Gasoline Data from a Third Party, Jun. 1992; 15 pages.

* cited by examiner

GASOLINE-OXYGENATE BLEND AND METHOD OF PRODUCING THE SAME

FIELD OF THE INVENTION

The present invention provides for gasoline-oxygenate blends containing at least one alcohol and methods of producing the same without the introduction of significant amounts of ethers.

BACKGROUND OF THE INVENTION

Gasolines are generally composed of a mixture of hydrocarbons, boiling at atmospheric pressure in a very narrow temperature range, e.g., 77° F. (25° C.) to 437° F. (225° C.). Gasolines are typically composed of mixtures of aromatics, olefins, and paraffins, although some gasolines may also contain such added non-hydrocarbons as alcohol (e.g., ethanol) or other oxygenates (e.g., methyl t-butyl ether ("MTBE"). Gasolines may also contain various additives, such as detergents, anti-icing agents, demulsifiers, corrosion inhibitors, dyes, deposit modifiers, and octane enhancers. The presence of oxygen in the fuel tends to raise the effective air-to-fuel ratio for combustion and fuel oxygen may effect catalyst efficiency. While the oxygen in ethanol can raise this air-to-fuel ratio which may increase combustion temperature, the lower temperature of combustion for ethanol mitigates this effect. The oxygen in ethanol also reduces carbon monoxide ("CO") and volatile organic compound ("VOC") emissions during high-emissions conditions in new vehicles and during all conditions for vehicles that do not have operational oxygen sensors or catalysts.

The passage of the Clean Air Act ("CAA") Amendments of 1990 has impacted all major transportation fuels in the United States and stimulated research into using alternative motor fuels that include oxygenates. In order to comply with the CAA, gasoline marketers admixed oxygenates into gasoline, but also changed the hydrocarbon composition by altering the content of benzene, total aromatics, butane, total olefins, and similar components. These considerations affect the reactivity of new gasolines and translate into the performance characteristics of admixed oxygenates, i.e., distillation, volatility, azeotropic behavior, oxidation stability, solubility, octane values, vapor pressure, and other gasoline characteristics known to those skilled in the art.

Research regarding oxygenated fuel substitutes and components has focused on aliphatic alcohols and ethers, including, but not limited to, methanol, ethanol, isopropanol, t-butanol, MTBE, ethyl t-butyl ether ("ETBE"), and t-amyl methyl ether ("TAME"). Most research has focused on using MTBE in gasoline formulation. Generally, oxygenate gasoline components have been blended into gasoline separately. However, there have been mixtures of such components disclosed, such as blends of gasoline containing components other than ethers, such as alcohols.

Historically, gasoline has usually embodied pressures of between about 9 to about 15 pounds per square inch ("PSI") of pressure. Recent evaporative emission regulations have forced the reduction of gasoline vapor pressures. Ether components provide advantageous vapor pressure blending characteristics for these gasolines. In the late 1990s, the CAA has now caused refiners to reformulate gasoline to achieve vapor pressures of about 7.5 to about 8.5 PSI. This is because the CAA is trying to reduce vehicle emissions that constitute air toxins and participate in the formulation of air pollution ("smog"), for example, CO, NOx, and VOCs. These lower vapor pressure requirements motivated the use of MTBE. It has been used in "premium" gasoline since 1979 as a high-octane additive to function as an oxygenate. In fact, MTBE has replaced lead and other highly contaminating additives such as benzene, toluene, ethylbenzene, and xylenes ("BTEX").

MTBE is an ether—having relatively low odor and taste thresholds compared to other organic compounds. MTBE's odor threshold in water is between about 45 and about 95 parts per billion ("ppb"). Its taste threshold in water is about 134 ppb. As a result, MTBE can be detected in drinking water through odor and taste at relatively low concentrations. Ultimately, MTBE is encountered through drinking contaminated water, use of the water in cooking, and inhalation during bathing.

Vast amounts of MTBE-containing gasoline are stored in underground storage tanks ("UST"), which have been known to leak. Seepage of MTBE from leaky tanks into groundwater and spillage of MTBE during tank filling operations and transfer operations at distribution terminals have led to considerable contamination of groundwater near these tanks. Because MTBE is highly soluble in water—about 43,000 parts per million ("PPM")—MTBE may be found as plumes in groundwater near service stations, related storage facilities, and filling terminals throughout the United States. See Steffan. Therefore, a need exists to exploit alternative sources of oxygenates as gasoline additives.

To this end, ethanol has been used as an alternative to MTBE in gasoline-oxygenate blends wherein the vapor pressure and emission requirements were less restrictive. Ethanol has some properties that are different than MTBE. However, ethanol blends have nearly twice the fuel-oxygen content of the MTBE blends. Furthermore, these ethanol blends exhibit as much as about 1 PSI higher Reid Vapor Pressure ("RVP") volatility absent pre-adjustment of the base clear-gasolines to accommodate this volatility. Accordingly, there exists a need to use an alternative to MTBE that provides acceptable volatility.

With mounting pressures being attributed to the use of ethers, ethanol continues to find increasing application in low-RVP gasolines. Cost-effective blending of "Specification," ethanol-containing gasoline require special characteristics and preparations. Substantiating this need, the 23-state Governors' Ethanol Coalition released a report entitled "The Fate and Transport of Ethanol-Blended Gasoline in the Environment" in 1999 that confirms that ethanol, a renewable oxygenate added to gasoline to make it burn cleaner, poses no threat to surface water and ground water. The report confirmed that, in California, more than 10,000 wells have been contaminated by MTBE and its pungent odor renders water undrinkable. In 1999, California Governor Gray Davis called for eliminating the use of MTBE in the state's gasoline. In fact, Executive Order D-5-99 requires a phase out and eventual elimination of MTBE use by Dec. 31, 2002. Accordingly, a need exists to reduce or replace MTBE additives in gasoline to make a cleaner burning fuel that still provides acceptable temperature and volatility characteristics.

SUMMARY OF THE INVENTION

The present invention provides gasoline-oxygenate blends that produce a relatively low amount of gaseous pollutants with the reduction or elimination of MTBE as a fuel additive. The invention provides methods for producing gasoline-oxygenate blends having such desirable properties as overall emission performance such as: the reduction of Toxics, NOx, and VOCs; oxygen content; and requisite volatility characteristics including vapor pressure, and the 200° F. and 300° F.

distillation fractions as discussed herein. This composition and its method of production offer a solution by including at least one alcohol while combating pollution, particularly in congested cities and the like, when large volumes of automotive fuel of the invention are combusted in a great number of automobiles in a relatively small geographical area.

The present invention, in its broadest aspect, is founded on the discovery that when gasolines are produced, for example, by blending a plurality of hydrocarbon-containing streams together so as to produce a gasoline-oxygenate blend, controlling certain chemical and/or physical properties of the gasoline-oxygenate blend can improve the reduction of emissions of one or more pollutants. For example, a first hydrocarbon-containing stream boiling in the gasoline range can be blended with a different hydrocarbon stream at rates adjusted so as to reduce the introduction of MTBE while improving the vapor pressure and the 50% Distillation Point. The greater decrease of the introduction of MTBE while maintaining the other properties of the blend as set forth above, the greater the resulting benefit in reducing emissions while fulfilling all regulatory requirements.

In summary, the present invention provides a gasoline-oxygenate blend composition and a method of producing the same containing at least one alcohol, most preferably ethanol, exhibiting greater than or equal to about nine (9) volume percent (%) of the composition and having a vapor pressure less than about 7.1 PSI which meets all ASTM Specifications and Federal/State Regulatory Requirements. In a preferred embodiment, the volume of this alcohol may be reduced to about seven (7) volume percent, or even about five (5) volume percent in a most preferred embodiment. Though this preferred embodiment utilizes ethanol, it is envisioned that virtually any alcohol may reduce or replace the introduction of MTBE in the blending process and the compositions formed therefrom.

In a preferred embodiment, the gasoline-oxygenate blend has a vapor pressure less than about 7.1 PSI and an alcohol content greater than about 5.8 volume percent. In another embodiment, this gasoline-oxygenate blend will have a 50% distillation point less than about 195° F., a 10% distillation point less than about 126° F., an oxygen weight percent that is greater than 1.8 weight percent, an anti-knock index greater than or equal to about 89, and/or the capability to reduce toxic air pollutants emissions by more than about 21.5% as calculated under the Complex Emissions Model ("Complex Model") under 40 C.F.R. §80.45 (1999), more preferably more than about 30% for the appropriate location, season, and year. Though the present invention may substitute virtually any alcohol for MTBE, the inclusion of ethanol to reduce or replace MTBE is preferable.

In another embodiment, the gasoline-oxygenate blend has a vapor pressure less than about 7.2 PSI and an alcohol content greater than about 9.6 volume percent. This embodiment may also have a 50% distillation point less than about 178° F., a 10% distillation point less than about 123° F., an oxygen weight percent that is greater than 1.8 weight percent, an anti-knock index greater than about 89, and/or the capacity to reduce toxic air pollutants emissions by more than about 21.5%. In another embodiment, the gasoline-oxygenate blend has a vapor pressure less than about 7 PSI and an alcohol content greater than about 5.0 volume percent. This embodiment may also have a 50% distillation point less than about 250° F. and/or a 10% distillation point less than about 158° F.

With regard to the forming of these gasoline-oxygenate blends, this invention also includes the process for preparing a gasoline-oxygenate blend by blending at least two hydrocarbon streams to produce a gasoline-oxygenate wherein the resulting blend has a vapor pressure less than about 7.1 PSI and an alcohol content greater than about 5.8 volume percent while reducing or eliminating the inclusion of MTBE. These gasoline-oxygenate blends may be formed by blending at least two hydrocarbon streams to produce a gasoline-oxygenate blend suitable for combustion in an automotive engine wherein the resulting blend has a vapor pressure less than about 7 PSI and an alcohol content greater than about 5.0 volume percent. This process can produce a blend that reduces toxic air pollutant emissions by more than about 21.5%, more preferably about 30%.

DETAILED DESCRIPTION OF PREFERRED EMBODIMENTS

Figure 1:
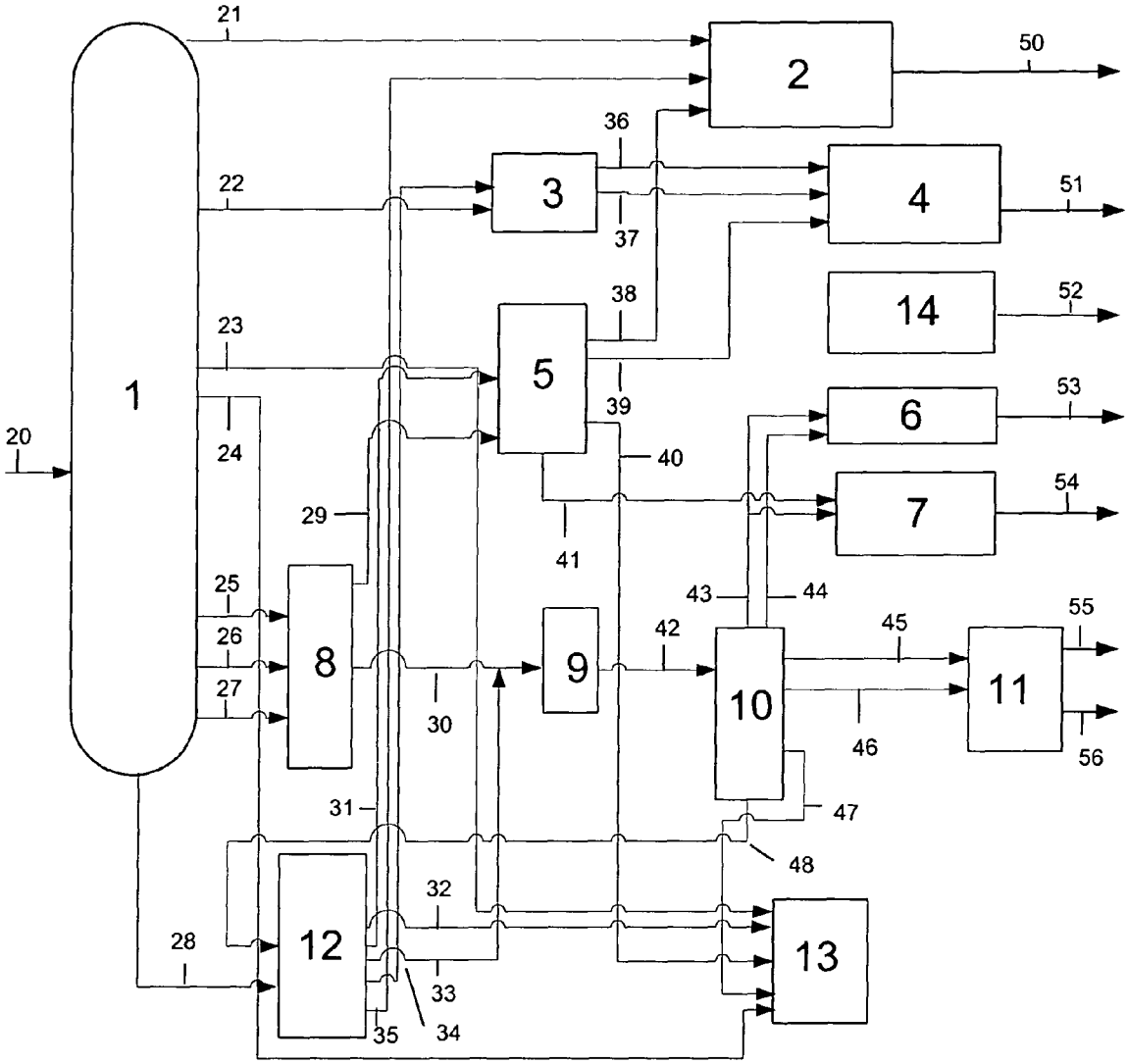
FIG. 1 shows a block diagram of a representative refinery.

Before discussing the preferred embodiments, some of the rules and regulations that preceded this invention will be discussed. Those skilled in the art will recognize that changes, amendments, or revisions to the rules, regulations, requirements, laws, and standards are considered to be within the scope of the invention and the benefits of the invention as described and claimed herein are not dependent on these factors.

The following terms, excerpted from the CAA, are helpful in understanding the following tables. Anti-knock index or octane number is the arithmetic average of the Research octane number ("RON") and Motor octane number ("MON"), that is (R+M)/2. The RON is determined by a method that measures fuel anti-knock level in a single-cylinder engine under mild operating conditions; namely, at a moderate inlet mixture temperature and a low engine speed. The RON tends to indicate fuel anti-knock performance in engines wide-open throttle and low-to-medium engine speeds. The MON is determined by a method that measures fuel anti-knock level in a single-cylinder engine under more severe operating conditions than those employed in the Research method; namely, at a higher inlet mixture temperature and at a higher engine speed. It indicates fuel anti-knock performance in engines operating at wide-open throttle and high engine speeds. Also, the MON tends to indicate fuel anti-knock performance under part-throttle, road-load conditions.

Additionally, Reid Vapor Pressure ("RVP") refers to the absolute vapor pressure of volatile crude oil and volatile non-viscous petroleum liquids, except liquefied petroleum gases, as determined by the *Standard Test Method for Vapor Pressure of Petroleum Products* (*Reid Method*), ASTM D 323. The vapor pressure or Dry Vapor Pressure Equivalents ("DVPE") can be determined following *the Standard Test Method for Vapor Pressure of Gasoline and Gasoline-Oxygenate Blends* (*Dry Method*) ASTM D 4953, the *Standard Test Method for Vapor Pressure of Petroleum Products* (*Automatic Method*) ASTM D 5190, the *Standard Test Method for Vapor Pressure of Petroleum Products* (*Mini Method*) ASTM D 5191, and the *Standard Test Method for Vapor Pressure of Petroleum Products* (*Mini Method-Atmospheric*) ASTM D 5482. With the terms in mind, fuels have some basic properties that are shown in Table 1 below.

TABLE 1

PROPERTIES OF FUELS

| Property | | Gasoline | No. 2 Diesel Fuel | Methanol | MTBE | Ethanol |
|---|---|---|---|---|---|---|
| Chemical Formula | | $C_4$ to $C_{12}$ | $C_3$ to $C_{25}$ | $CH_3OH$ | $(CH_3)COCH_3$ | $C_2H_5OH$ |
| Molecular Weight | | 100-105 | ~200 | 32.04 | 88.5 | 46.07 |
| Composition | Carbon | 85-88 | 84-87 | 37.5 | 66.1 | 52.2 |
| (weight %) | Hydrogen | 12-15 | 33-16 | 12.6 | 13.7 | 13.01 |
| | Oxygen | 0 | 0 | 49.9 | 18.2 | 34.7 |
| Boiling temperature (° F.) | | 80-437 | 370-650 | 149 | 131 | 172 |
| RVP (PSI) | | 8-15 | 0.2 | 4.6 | 7.8 | 2.3 |
| RON | | 90-100 | — | 107 | 116 | 108 |
| MON | | 81-90 | — | 92 | 101 | 92 |
| (R + M)/2 | | 86-94 | N/A | 100 | 108 | 100 |

These fuels must meet several requirements. Some of these requirements are related to the Vapor Pressure and Distillation Class. The *Standard Specification for Automotive Spark-Ignition Engine Fuel*, ASTM D 4814, sets out vapor pressure and distillation class requirements for each vapor pressure and distillation class.

TABLE 2

VAPOR PRESSURE AND DISTILLATION CLASS REQUIREMENTS

| Vapor Pressure/ Distillation Class | Vapor Pressure Max, kPa(PSI) | The Temperature at which the specified percentage of the fuel has evaporated ° C.(° F.) | | | |
|---|---|---|---|---|---|
| | | 10% max | 50% min | 50% max | 90% max |
| AA | 54(7.8) | 70(158) | 77(170) | 121(250) | 190(374) |
| A | 62(9.0) | 70(158) | 77(170) | 121(250) | 190(374) |
| B | 69(10.0) | 65(149) | 77(170) | 118(245) | 190(374) |
| C | 79(11.5) | 60(140) | 77(170) | 116(240) | 185(365) |
| D | 93(13.5) | 55(131) | 66(150) | 113(235) | 185(365) |
| E | 103(15.0) | 50(122) | 66(150) | 110(230) | 185(365) |

To model this, the CAA lays out standards and appropriate Emission Models to calculate performance of gasoline blends. The following properties of the baseline fuels must be observed when blending gasolines. In addition to the properties discussed the following terms are included in the following table from the Complex Model of 40 C.F.R. §80.45 (1999). E200 is the fraction of the target fuel that evaporates (the distillation fraction) at 200° F. in terms of volume percent. E300 is the fraction of the target fuel that evaporates (the distillation fraction) at 300° F. in terms of volume percent.

TABLE 3

COMPLEX EMISSIONS MODEL FOR THE BASELINE FUEL PROPERTIES

| Fuel property | Summer | Winter |
|---|---|---|
| Oxygen (wt %) | 0.0 | 0.0 |
| Sulfur (PPM) | 339 | 338 |
| RVP (PSI) | 8.7 | 11.5 |
| E200 (%) | 41.0 | 50.0 |
| E300 (%) | 83.0 | 83.0 |
| Aromatics (vol %) | 32.0 | 26.4 |
| Olefins (vol %) | 9.2 | 11.9 |
| Benzene (vol %) | 1.53 | 1.64 |

Not only must these fuel properties be observed, the fuels must not exceed the following baseline exhaust emissions. The abbreviations for polycyclic organic matter ("POM") and Nitric Oxide ("NOx") are used in the following table that lists the baseline exhaust emissions for Phase I (the Years 1995-1999) and Phase II (the Year 2000 and beyond).

TABLE 4

BASELINE EXHAUST EMISSIONS

| Exhaust pollutant | Phase I Summer (mg/mile) | Phase I Winter (mg/mile) | Phase II Summer (mg/mile) | Phase II Winter (mg/mile) |
|---|---|---|---|---|
| VOC | 446.0 | 660.0 | 907.0 | 1341.0 |
| NOx | 660.0 | 750.0 | 1340.0 | 1540.0 |
| Benzene | 26.10 | 37.57 | 53.54 | 77.62 |
| Acetaldehyde | 2.19 | 3.57 | 4.44 | 7.25 |
| Formaldehyde | 4.85 | 7.73 | 9.70 | 15.34 |
| 1,3-Butadiene | 4.31 | 7.27 | 9.38 | 15.84 |
| POM | 1.50 | 2.21 | 3.04 | 4.50 |

Ultimately, these properties and baselines are promulgated to insure compliance with the Total Baseline for VOCs, NOx, and Toxic Emissions in both Phases I and II, in Region 1, the Southern States, and Region 2, the Northern States as shown in the following table.

TABLE 5

| TOTAL BASELINE VOC, NOX AND TOXICS EMISSIONS | | | | | | | | |
|---|---|---|---|---|---|---|---|---|
| | Summer (mg/mile) | | | | Winter (mg/mile) | | | |
| | Phase I | | Phase II | | Phase I | | Phase II | |
| Pollutant | Region 1 | Region 2 | Region 1 | Region 2 | Region 1 | Region 2 | Region 1 | Region 2 |
| NOx | 660.0 | 660.0 | 1340.0 | 1340.0 | 750.0 | 750.0 | 1540.0 | 1540.0 |
| VOC | 1306.5 | 1215.1 | 1466.3 | 1399.1 | 660.0 | 660.0 | 1341.0 | 1341.0 |
| Toxics | 48.61 | 47.58 | 86.34 | 85.61 | 58.36 | 58.36 | 120.55 | 120.55 |

With these requirements, models, and standards in place, the following outlines how to meet these standards while reducing or eliminating the introduction of MTBE. In fact, the following demonstrates how to reduce Toxic Emissions ("ToxR") by about 30% such that the Phase II Summer Emissions are from about 53.5 mg/mile to about 37.5 mg/mile using the calculations shown in 40 C.F.R. §80.45 (1999).

To blend at least one gasoline-oxygenate blend that complies with these requirements, the following refinery produced several blends that were tested for compliance with these requirements. With reference to FIG. 1, a block flow diagram of one embodiment of a refinery is shown. As with most refineries, a number of different units have been integrated into a processing sequence. Those skilled in the art will appreciate that virtually combinations and permutations of the units shown in different configurations may be arranged or configured to effectuate the goal of creating refinery products while reducing or eliminating the introduction of MTBE.

The block diagram shows units for separation, conversion, and blending. As with most oil refineries, the representative refinery depicted in FIG. 1 separates crude oil into its various fractions, converts these fractions into distinct components, and finally blends those components into finished products. This separation of petroleum crude into its various fractions takes place in a crude distillation tower 1. As shown, crude distillation tower 1 is an atmospheric and vacuum distillation tower.

The resulting hot vapors rise and cool at various levels within the distillation tower 1, condensing on horizontal trays. As these vapors rise, they cool and condense at various levels where they are caught by a number of horizontal trays. The trays at the top of the unit collect the lighter petroleum fractions, while the heavier components settle on the lower trays. Prior to introduction, crude oil may be first heated in a furnace.

The trays on the upper levels collect the lighter petroleum fractions such as naphtha (straight-run gasoline) and kerosene. Middle trays collect components such as light heating oil and diesel fuel. Heavy fuel oils, asphalt, and pitch fractions settle on lower trays. Some of the components may be collected as conversion feeds in conversion feed unit 8. Those vapors that do not condense in the distillation tower 1 are removed from the top as light gases.

At each condensation level, the separated fractions are removed from the trays through pipes known as side draws. The heaviest liquid residue is drawn off at the bottom of the tower as reduced crude through line 28. This may be sent to a coker unit 12. Moreover, some of the lines from the distillation tower 1 may run to a distillation fuels collection unit 13.

Each of these streams may undergo some form of conversion, isomerization, or other change. The most common conversion processes are cracking, combining, and rearranging. FIG. 1 shows several units capable of this process, including, but not limited to a fluid catalytic cracking unit 10.

The fluid catalytic cracking unit 10 converts gas oil from the crude distillation tower 1 into gasoline blending stocks and fuel oils. It does this through a conversion process known as cracking. Catalytic cracking breaks down larger, heavier, and more complex hydrocarbon molecules into simpler and lighter molecules by applying heat, pressure, and a catalyst. Catalytic cracking may further occur in the hydrolytic cracker 5.

Additionally, this flow diagram shows the process of alkylation and polymerization being included in this refinery. These processes link smaller, lighter molecules to form larger, heavier ones. Alkylation and polymerization units such as the alkylation unit 7 and the polymerization/dimerization unit 6 produce high-octane gasoline blending stock from cracked gases.

Reformers and isomerization units such as isomerization and/or saturated hydrodesulfuration unit 2 and catalytic reformer 4 offer these benefits to the process shown. Typically, a reformer converts naphthas or low-octane gasoline fractions in the presence of heat, pressure, and at least one catalyst into higher octane stocks suitable for blending into gasoline.

Isomerization units such as isomerization and/or saturated hydrodesulfuration unit 2 rearrange the molecules from straight-chain, low-octane hydrocarbons to branched-chain, high-octane hydrocarbons known as isomers. The resulting isomerate is a preferred gasoline blending stock.

Moreover, some petroleum fractions have sulfur, nitrogen, heavy metals, and other impurities in them. These contaminants may have detrimental effects on equipment, catalysts, and the quality of the finished product. Hydrotreating is a conversion process that removes many of these impurities by mixing untreated fractions with hydrogen in the presence of a catalyst. The naphtha hydrodesulfuration unit 3, the catalytic feed hydrotreater 9, and the catalytic gasoline hydrotreater 11 are examples of units that may be included in a refinery to remove these impurities.

These units are typically connected by a plurality of pipes or similar transfer conduits known to those skilled in the art to offer continuous feeds. In the preferred embodiment depicted herein, line 20 feeds crude oil into distillation tower 1.

Numerous lines lead from distillation tower 1. Lines 21, 22, 23, 24, 25, 26, 27, and 28 lead from the distillation tower 1. Line 21 may run to an isomerization and/or saturated hydrodesulfuration unit 2. Line 21 may contain straight run light gasoline. Line 22 may run to a naphtha hydrodesulfuration unit 3. Line 22 may contain straight run naphthalene. Lines 23 and 24 may run to a distillation fuels collection unit 13. Line 23 may contain straight run kerosene. Line 24 may contain straight run, light gas oil.

Lines 25, 26, and 27 may run to conversion feeds unit 8. Line 25 may contain straight heavy gas oil. Line 26 may contain straight run, light vacuum gas oil. Line 27 may contain straight run, heavy vacuum gas oil. Line 28 may run to a coker 12. Line 28 may contain vacuum residuum. The oils collected in the collection feed unit 8 may feed into a hydrolytic cracker 5 and a catalytic feed hydrotreater 9 via lines 29 and 30, respectively. Each straight run product may undergo further processing by various other refinery units before becoming marketable end products.

As shown, lines 31, 32, 33, 34, and 35 lead from the coker 12. Line 31 may run to the hydrolytic cracker 5 and may contain coker heavy gas oil. Line 32 may run to the distillation fuels collection unit 13 and may contain coker light gas oil. Line 33 may run to the catalytic feed hydrotreater 9 and may contain coker heavy gas oil. Line 34 may run to the naphtha hydrodesulfuration unit 3 and may contain coker naphtha. Line 35 may run to the isomerization and/or saturated hydrodesulfuration unit 2 and may contain coker naphtha. Lines 36 and 37 may run to the catalytic reformer 4.

Line 38 may run to the isomerization and/or saturated hydrodesulfuration unit 2 and may contain hydrolytically cracked light gasoline. Line 39 may run to the catalytic reformer 4 and may contain hydrolytically cracked naphtha. Line 40 may run to the distillation fuels collection unit 13 and may contain hydrolytically cracked gas and/or oil. Line 41 may run to the alkylation unit 7 and may contain hydrocarbons such as butane.

Line 42 may run to the fluid catalytic cracking unit 10. From the fluid catalytic cracking unit 10, line 43 may run to at least one of the polymerization/dimerization unit 6 and/or the alkylation unit 7 and may contain at least one hydrocarbon such as propane. Line 44 may also run to polymerization/dimerization unit 6 and may contain a hydrocarbon such as butane. Lines 45 and 46 may run to the catalytic gasoline hydrotreater 11 and may contain fluid catalytic cracked light naphtha and fluid catalytic cracked heavy naphtha, respectively. Line 47 may run to the distillation fuels collection unit 13 and may contain fluid catalytic cracked light gas oil. Line 48 may lead to the coker unit 12 and may contain fluid catalytic cracked heavy cycle oil and slurry.

A third significant part of the refinery process is blending. Final products may be obtained by mixing two or more blending components as well as additives to improve product quality. To this end, most grades of motor gasoline are blends of various fractions including straight-run naphthas, reformate, cracked gasoline, isomerate, and poly-gasoline. Other blended products include fuel oils, diesel fuels, jet fuels, lubricating oils, and asphalts.

This blending process is an important aspect of the present invention. The gasoline compositions and the blends utilized to obtain these compositions and properties are disclosed herein. Though this disclosure shows the benefits of the inclusion of at least some ethanol in the blending process, those skilled in the art will realize the process and compositions may utilize virtually any alcohol to reduce or eliminate the introduction of MTBE in the blending process. As shown herein, product lines 50, 51, 52, 53, 54, 55, and 56 are shown. Line 50 may come from the isomerization and/or saturated hydrodesulfuration unit 2 and may contain straight run, hydrolytically cracked light gasoline and/or isomerate. Line 51 may come from the catalytic reformer 4 and may contain reformate. Line 52 will be discussed below. Line 53 may come from the polymerization/dimerization unit 6 and may contain polymerized/dimerized gasoline. Line 54 may come from the alkylation unit 7 and may contain alkylate. Lines 55 and 56 may come from the catalytic gasoline hydrotreater 11 and may contain catalytically hydrotreated gasoline light and heavy catalytically hydrotreated gasoline, respectively.

Additionally, the oxygenates may be introduced via oxygenate unit 14 in a line 52. The oxygenates such as an alcohol may be introduced to the stream output of lines 50, 51, 53, 54, 55, and/or 56. In the most preferred embodiment, the introduction of ethanol occurs via line 52. It is important and advantageous to note that the only oxygenate needed in the preferred embodiment is ethanol. Other alcohols that may be used include but are not limited to methanol, propanol, isopropanol, butanol, secondary butanol, tertiary-butanol, alcohols having about five carbon atoms, and similar alcohols. In the preferred embodiment, oxygenate unit is not located at the refinery. Oxygenates, such as ethanol, may be added to the finished gasoline downstream of the gasoline blending process. Accordingly, the present invention may benefit from the blending of the oxygenates at a remote location not physically located at the refinery.

Using this refinery and blending process, the following blends have been produced. After showing the composition of the blends, the properties of these blends are discussed. Furthermore, the effect of including oxygenates in the blends will be shown. These compositions of the blends with oxygenates are shown. Finally, the properties of the blends, including oxygenates, will be shown and discussed.

Prior to the introduction of the next table, the volume percentage of streams that were blended prior to the introduction of oxygenates, the following column heading meanings are needed. "C4" is used in the following tables to denote the inclusion of hydrocarbons such as butane.

The "FFB" usually includes a stream of hydrocarbons wherein the number of carbon atoms in each molecule of the hydrocarbon is preferably between about 4 and about 5. The FFB may preferably be a portion of stream 41, a separated product from hydrolytic cracker 5, combined with a portion of the straight-run gasoline from line 21. In a preferred embodiment, FFB is about 20% butane, about 65% isopentane, and remainder normal-pentane. In a preferred embodiment, the straight run gasoline is caustic treated to remove mercaptan sulfur and combined with other streams which are separated by using a fractionation column.

"RAFF," raffinate, refers to the paraffin portion of straight run naphtha and hydrolytically cracked light naphtha from the stream 36 after it has run through a catalytic reformer 4 and preferably a benzene extraction unit. Raffinate usually includes a stream of paraffinic hydrocarbons wherein the number of carbon atoms in each molecule of the hydrocarbon is preferably between about 5 and about 7 in the light reformate product.

"HOR" is used in the following tables to denote the inclusion of at least one high octane reformate, preferably a product in the line 51 from the catalytic reformer unit 4. "TOL" is the aromatic portion of stream 36 as described above, which no longer has a significant benzene content. In a preferred embodiment, TOL is essentially about 65-70 volume percent toluene, about 10-15 volume percent mixed xylenes, and the remainder is paraffinic hydrocarbons wherein the number of carbon atoms in each molecule of the hydrocarbon is preferably about 8 or more.

"LCC" is used in the following tables to denote the inclusion of at least one light catalytically cracked gasoline. Preferably, LCC is a combination of light catalytically cracked gasoline from stream 45 and light hydrolytically cracked gasoline from stream 38 after these products have been caustic treated to remove mercaptans.

"HCC" is used in the following tables to denote the inclusion of at least one heavy fluid catalytically cracked gasoline such as the product in line 46 and light straight run gasoline 21 after these products have been caustic treated to remove mercaptans.

"ALKY" is used in the following tables to denote the inclusion of at least one alkylate such as the product from the line 54 from the alkylation unit 7 in the preferred embodiment.

"LSCC" denotes the heaviest portion of stream 46—the heavy fluid catalytically cracked gasoline in line 56 after it has been hydrotreated to reduce the sulfur content. Those skilled in the art will recognize that the inclusion of any low-sulfur catalytically cracked gasoline, regardless of how provided, may be used in this fashion and that it is likely that this stream may have been hydrotreated to reduce the sulfur content to an acceptably low level.

With these terms in mind, the following Tables 6-15 show blends that have been made. These tables have been divided into blends that were made in 1999 represented by Tables 6-10 and blends that have been made after 1999 in Tables 11-15. Adopting the terms "Phase I" (the Years 1995-1999) and "Phase II" (the Year 2000 and beyond), the following tables provide examples that were blended under both Phase I and Phase II.

Additionally, prior to the introduction of any oxygenates, each blend will be referred to as a "neat" blend. Once oxygenates have been introduced, each blend will be referred to as a gasoline-oxygenate blend. With these terms in mind, the following tables show the recipes and properties of these blends. Tables 6 and 11 show the neat blend recipes in Phase I and Phase II, respectively. Tables 7 and 12 show the neat blend properties in Phase I and Phase II, respectively. Tables 8 and 13 show the gasoline-oxygenate blend recipes in Phase I and Phase II, respectively. Tables 9 and 14 show the gasoline-oxygenate blend properties in Phase I and Phase II, respectively. Finally, Tables 10 and 15 show the additional gasoline-oxygenate blend properties in Phase I and Phase II, respectively.

Of note, the percentage reduction of NOx, toxic pollutants, and VOCs shown in Tables 10 and 15 were calculated using the Complex Model that was in effect during the appropriate Phase. For example, the percentage reductions shown in Table 10, entitled "Additional Phase I Gasoline-Oxygenate Blend Properties," show calculations based on the Complex Model Phase I as prescribed in 40 C.F.R. §80.45 (1999). Accordingly, Table 15, entitled "Additional Phase II Gasoline-Oxygenate Blend Properties," shows the percentage reduction of NOx, toxic pollutants, and VOCs using the Complex Model Phase II as prescribed by Federal Regulations under 40 C.F.R. §80.45 (1999).

With respect to percentage reductions described herein, unless otherwise indicated, the Phase II Complex Model for determining the percentage reduction of NOx, toxic pollutants, and/or VOCs are to be calculated under the Phase II Complex Model as prescribed in 40 C.F.R. §80.45 (1999) unless otherwise indicated. Returning to the following Table 6, entitled "Phase I Neat Blend Recipes," the following neat blends were formulated.

TABLE 6

PHASE I NEAT BLEND RECIPES

| BLEND | C4 | FFB | RAFF | HOR | TOL | LCC | ALKY | LSCC | HCC |
|---|---|---|---|---|---|---|---|---|---|
| | (in terms of volume percent of the total blend) (%) | | | | | | | | |
| A | 0.0 | 1.4 | 0.0 | 22.9 | 19.8 | 8.9 | 47.0 | 0.0 | 0.0 |
| B | 0.0 | 0.0 | 17.0 | 17.9 | 10.4 | 0.0 | 26.4 | 11.7 | 16.6 |
| C | 1.6 | 0.0 | 0.0 | 16.5 | 30.5 | 14.8 | 36.6 | 0.0 | 0.0 |
| D | 0.0 | 0.0 | 17.4 | 27.4 | 0.0 | 14.1 | 17.4 | 20.5 | 3.2 |
| E | 0.0 | 0.0 | 25.0 | 27.9 | 0.0 | 0.0 | 17.5 | 18.6 | 10.9 |
| F | 0.0 | 0.0 | 10.1 | 10.2 | 36.3 | 18.2 | 25.2 | 0.0 | 0.0 |
| G | 0.1 | 3.7 | 0.0 | 38.0 | 7.9 | 10.5 | 39.7 | 0.0 | 0.0 |
| H | 0.0 | 0.0 | 13.8 | 17.1 | 0.0 | 0.1 | 28.3 | 20.5 | 20.1 |
| I | 0.0 | 2.0 | 21.1 | 9.7 | 21.3 | 12.5 | 10.7 | 22.7 | 0.0 |
| J | 0.0 | 1.6 | 0.0 | 35.1 | 10.6 | 14.3 | 36.1 | 0.0 | 2.3 |
| K | 0.0 | 0.0 | 22.4 | 19.3 | 14.8 | 8.0 | 22.9 | 11.1 | 1.5 |
| L | 0.0 | 0.0 | 25.9 | 17.8 | 8.1 | 14.7 | 12.0 | 18.8 | 2.8 |
| M | 0.0 | 0.0 | 12.9 | 21.1 | 0.2 | 11.0 | 22.4 | 19.0 | 13.4 |
| N | 0.0 | 0.8 | 20.3 | 4.6 | 25.7 | 19.3 | 0.0 | 19.2 | 10.2 |
| O | 0 | 3 | 0 | 22.8 | 17.7 | 10.1 | 40.2 | 0 | 6.3 |
| P | 0.0 | 0.0 | 17.7 | 0.0 | 21.3 | 7.4 | 21.5 | 17.5 | 14.7 |
| Q | 0.0 | 0.0 | 19.7 | 5.2 | 16.2 | 3.7 | 14.2 | 20.6 | 20.5 |
| R | 0.0 | 0.0 | 22.7 | 19.2 | 5.9 | 8.0 | 6.4 | 26.4 | 11.3 |
| S | 0.0 | 1.1 | 12.8 | 0 | 29.4 | 16.1 | 40.7 | 0 | 0 |
| T | 0.0 | 0.0 | 14.9 | 16.9 | 4.6 | 17.1 | 13.6 | 29.4 | 3.6 |
| U | 0.0 | 0.0 | 4.7 | 14.2 | 17.4 | 8.3 | 35.6 | 0 | 19.5 |
| V | 0.0 | 0.0 | 21.2 | 14.7 | 0 | 0 | 19.1 | 29.7 | 15.2 |
| W | 0.0 | 0.0 | 0 | 35.4 | 13.1 | 29.6 | 21.8 | 0 | 0 |
| X | 0.0 | 0.0 | 10.7 | 0 | .4 | .8 | 38.2 | 26.6 | 23.3 |

These neat blends were tested online using certified online analyzers calibrated to ASTM standards and methods. The following Table 7 includes neat blend properties wherein each blend, designated by a letter designation A-X, corresponds to the same letter designation A-X from Table 6.

The Research Octane Number ("RON") and the Motor Octane Number ("MON") were collected using calibrated online analyzers using the testing procedures found in the *Standard Text Method for Research and Motor Method Octane Ratings Using Online Analyzers*, ASTM D 2885. The anti-knock index number or octane number ("(R+M)/2") was established by averaging RON and MON. The DVPE was established by using an online testing method certified equivalent for the testing procedures found in *The Standard Test Method for Vapor Pressure of Petroleum Products* (*Mini Method*), ASTM D 5191 and is expressed in PSI. The 10% distillation temperature, the 50% distillation temperature, the 90% distillation temperature, the end point distillation temperate ("T10", "T50", "T90", and "EP" respectively) and the 200° F. and the 300° F. distillation fractions ("E200" and "E300", respectively) were collected using certified online procedures equivalent to the testing methods found in *The Standard Specification for Automotive Spark-Ignition Engine Fuel*, ASTM D 4814. With these testing procedures in mind, the neat blends had the following properties prior to the introduction of oxygenates.

TABLE 7

PHASE I NEAT BLEND PROPERTIES

| Blend | RON | MON | (R + M)/2 | DVPE PSI | T10 ° F. | T50 ° F. | T90 ° F. | EP ° F. | E200 Vol. % | E300 Vol. % |
|---|---|---|---|---|---|---|---|---|---|---|
| A | 97.2 | 88.4 | 92.8 | 5.8 | 158.4 | 227.0 | 309.5 | 401.8 | 30.0 | 86.8 |
| B | 91.1 | 83.6 | 87.35 | 5.7 | 146.8 | 226.8 | 338.9 | 421.6 | 34.9 | 80.4 |
| C | 98.2 | 88.1 | 93.15 | 5.7 | 159.9 | 230.6 | 304.0 | 405.9 | 27.2 | 88.9 |
| D | 88 | 81 | 84.5 | 5.7 | 142.1 | 224.7 | 346.1 | 419.4 | 38.8 | 75.7 |
| E | 88.0 | 81.9 | 84.95 | 5.5 | 144.5 | 224.8 | 347.9 | 420.0 | 38.2 | 75.7 |
| F | 97.1 | 86.6 | 91.85 | 5.6 | 150.1 | 222.0 | 299.1 | 404.5 | 34.4 | 90.0 |
| G | 96.3 | 87.4 | 91.85 | 5.6 | 148.7 | 227.2 | 325.6 | 413.6 | 32.4 | 83.2 |
| H | 88.7 | 82.6 | 85.65 | 5.6 | 145.4 | 223.6 | 349.0 | 419.5 | 36.9 | 77.6 |
| I | 88.4 | 81.2 | 84.8 | 5.6 | 144.9 | 227.3 | 332.8 | 423.3 | 35.7 | 81.5 |
| J | 96.7 | 87.0 | 91.85 | 5.5 | 148.6 | 228.3 | 326.8 | 416.1 | 31.9 | 83.2 |
| K | 90.6 | 84.1 | 87.35 | 5.8 | 146.0 | 218.6 | 320.5 | 415.2 | 38.7 | 84.9 |
| L | 87.9 | 82.1 | 85 | 5.6 | 142.6 | 217.2 | 342.4 | 420.8 | 41.8 | 79.6 |
| M | 88.3 | 82.7 | 85.5 | 5.6 | 142.8 | 221.1 | 345.3 | 421.0 | 39.3 | 78.4 |
| N | 88.1 | 81.5 | 84.8 | 5.6 | 143.0 | 219.7 | 337.1 | 428.0 | 39.9 | 82.0 |
| O | 96.3 | 87.3 | 91.8 | 5.8 | 149.7 | 226.4 | 313.5 | 410.4 | 31.7 | 86.5 |
| P | 90.1 | 82.7 | 86.4 | 5.7 | 145.3 | 221.5 | 324.1 | 420.0 | 37.2 | 84.4 |
| Q | 89.4 | 82.5 | 85.95 | 5.7 | 145.4 | 227.2 | 341.0 | 424.1 | 36.3 | 79.4 |
| R | 87.9 | 80.9 | 84.4 | 5.8 | 143.6 | 225.5 | 336.9 | 415.5 | 38.0 | 78.9 |
| S | 96.2 | 87.4 | 91.8 | 5.7 | 151 | 215.1 | 279.8 | 373 | 37.7 | 92.2 |
| T | 88 | 80.9 | 84.5 | 5.7 | 145 | 228 | 339.8 | 417.7 | 36.2 | 77.9 |
| U | 95.9 | 87.6 | 91.8 | 5.6 | 150.1 | 223.6 | 318.1 | 416.3 | 33.5 | 85.0 |
| V | 87.9 | 82 | 85 | 5.8 | 146.4 | 224 | 342.2 | 416.7 | 37.2 | 77.7 |
| W | 96.5 | 87.4 | 91.9 | 5.8 | 146.1 | 227 | 324.2 | 400.7 | 34.4 | 83.3 |
| X | 88.6 | 83.4 | 86 | 5.7 | 146.2 | 223.3 | 352.8 | 420.3 | 35.8 | 78.5 |

Oxygenates were introduced via an oxygenate unit 14 in a line 52. As mentioned previously, the inclusion of oxygenates does not have to occur on the premises of the refinery. With regard to these blends, the oxygenate was added to the finished gasoline downstream of the gasoline blending process. To each of these blends, oxygenates were introduced such that the oxygenates of the blend comprised less than or equal to about ten (10) volume percent. Each of the gasoline-oxygenate blends contained denatured ethanol meeting the *Standard Specification for Denatured Fuel Ethanol for Blending with Gasolines for Use as Automotive Spark-Ignition Engine Fuel* ASTM D 4806 as the oxygenate.

The following Table 8, entitled "Phase I Gasoline-Oxygenate Blend Recipes," shows a series of blend recipes that resulted in the gasoline-oxygenate blends after the introduction of at least one oxygenate to the corresponding neat blends shown in Table 6-7. Of note, a significant amount of the blends A-X were used in the formulation of two gasoline-oxygenate blends. For example, neat blend A shown in Tables 6-7 was blended with ethanol to form a gasoline-oxygenate blend A1 wherein the ethanol was about 9.5 volume percent. Similarly, this same neat blend A was blended with ethanol to create the gasoline-oxygenate blend A2 wherein the ethanol content was about 5.42 volume percent. Therefore, the gasoline-oxygenate blends A1 and A2 represent variations in the introduction of oxygenates to neat blend A.

The Phase I gasoline-oxygenate blend recipes shown in Table 8 are arranged such that the corresponding blend letter relates to the corresponding blend letter shown in Table 6-7. In the event that a plurality of gasoline-oxygenate Phase I blend recipes were made for each neat blend A-X, the corresponding gasoline-oxygenate Phase I blend recipes in Table 8 have been designated by the blend letter designation, for example A, followed by a numerical designation, for example 1, such that the gasoline-oxygenate property shown in Tables 9-10 correspond to the blend letter, and number designation, if applicable. Accordingly, Table 8, entitled "Phase I Gasoline-Oxygenate Blend Recipes," shows each gasoline-oxygenate blend recipe in terms of volume percent of the total blend after the introduction of oxygenates.

TABLE 8

PHASE I GASOLINE-OXYGENATE BLEND RECIPES

| BLEND | EtOH | C4 | FFB | RAFF | HOR | TOL | LCC | ALKY | LSCC | HCC |
|---|---|---|---|---|---|---|---|---|---|---|
| | (in terms of volume percent of the total blend) (%) | | | | | | | | | |
| A1 | 9.50 | 0.00 | 1.27 | 0.00 | 20.72 | 17.92 | 8.05 | 42.54 | 0.00 | 0.00 |
| A2 | 5.42 | 0.0 | 1.3 | 0.0 | 21.7 | 18.7 | 8.4 | 44.5 | 0.0 | 0.0 |
| B1 | 9.50 | 0.00 | 0.00 | 15.39 | 16.20 | 9.41 | 0.00 | 23.89 | 10.59 | 15.02 |
| B2 | 5.42 | 0.0 | 0.0 | 16.1 | 16.9 | 9.8 | 0.0 | 25.0 | 11.1 | 15.7 |
| C1 | 9.50 | 1.45 | 0.00 | 0.00 | 14.93 | 27.60 | 13.39 | 33.12 | 0.00 | 0.00 |
| C2 | 5.42 | 1.5 | 0.0 | 0.0 | 15.6 | 28.8 | 14.0 | 34.6 | 0.0 | 0.0 |
| D1 | 9.50 | 0 | 0 | 15.7 | 24.8 | 0 | 12.8 | 15.7 | 18.6 | 2.9 |
| D2 | 5.42 | 0.0 | 0.0 | 16.5 | 25.9 | 0.0 | 13.3 | 16.5 | 19.4 | 3.0 |
| E1 | 9.50 | 0.00 | 0.00 | 22.63 | 25.25 | 0.00 | 0.00 | 15.84 | 16.83 | 9.86 |
| E2 | 5.42 | 0.0 | 0.0 | 23.6 | 26.4 | 0.0 | 0.0 | 16.6 | 17.6 | 10.3 |
| F1 | 9.50 | 0.00 | 0.00 | 9.14 | 9.23 | 32.85 | 16.47 | 22.81 | 0.00 | 0.00 |
| F2 | 5.42 | 0.0 | 0.0 | 9.6 | 9.6 | 34.3 | 17.2 | 23.8 | 0.0 | 0.0 |
| G1 | 9.50 | 0.09 | 3.35 | 0.00 | 34.39 | 7.15 | 9.50 | 35.93 | 0.00 | 0.00 |
| G2 | 5.42 | 0.1 | 3.5 | 0.0 | 35.9 | 7.5 | 9.9 | 37.5 | 0.0 | 0.0 |
| H | 9.50 | 0.00 | 0.00 | 12.49 | 15.48 | 0.00 | 0.09 | 25.61 | 18.55 | 18.19 |

TABLE 8-continued

PHASE I GASOLINE-OXYGENATE BLEND RECIPES

| BLEND | EtOH | C4 | FFB | RAFF | HOR | TOL | LCC | ALKY | LSCC | HCC |
|---|---|---|---|---|---|---|---|---|---|---|
| | (in terms of volume percent of the total blend) (%) | | | | | | | | | |
| I1 | 9.50 | 0.00 | 1.81 | 19.10 | 8.78 | 19.28 | 11.31 | 9.68 | 20.54 | 0.00 |
| I2 | 5.42 | 0.0 | 1.9 | 20.0 | 9.2 | 20.1 | 11.8 | 10.1 | 21.5 | 0.0 |
| J1 | 9.50 | 0.00 | 1.45 | 0.00 | 31.77 | 9.59 | 12.94 | 32.67 | 0.00 | 2.08 |
| J2 | 5.42 | 0.0 | 1.5 | 0.0 | 33.2 | 10.0 | 13.5 | 34.1 | 0.0 | 2.2 |
| K1 | 9.50 | 0.00 | 0.00 | 20.27 | 17.47 | 13.39 | 7.24 | 20.72 | 10.05 | 1.36 |
| K2 | 5.42 | 0.0 | 0.0 | 21.2 | 18.3 | 14.0 | 7.6 | 21.7 | 10.5 | 1.4 |
| L1 | 9.40 | 0.00 | 0.00 | 23.47 | 16.13 | 7.34 | 13.32 | 10.87 | 17.03 | 2.54 |
| L2 | 5.42 | 0.0 | 0.0 | 24.5 | 16.8 | 7.7 | 13.9 | 11.3 | 17.8 | 2.6 |
| M | 9.50 | 0.00 | 0.00 | 11.67 | 19.10 | 0.18 | 9.96 | 20.27 | 17.20 | 12.13 |
| N | 9.72 | 0.00 | 0.72 | 18.33 | 4.15 | 23.20 | 17.42 | 0.00 | 17.33 | 9.21 |
| O1 | 9.79 | 0.00 | 2.71 | 0.00 | 20.57 | 15.97 | 9.11 | 36.26 | 0.00 | 5.68 |
| O2 | 5.42 | 0.0 | 2.8 | 0.0 | 21.6 | 16.7 | 9.6 | 38.0 | 0.0 | 6.0 |
| P | 9.72 | 0.00 | 0.00 | 15.98 | 0.00 | 19.23 | 6.68 | 19.41 | 15.80 | 13.27 |
| Q | 9.64 | 0.00 | 0.00 | 17.80 | 4.70 | 14.64 | 3.34 | 12.83 | 18.61 | 18.52 |
| Q2 | 5.42 | 0.0 | 0.0 | 18.6 | 4.9 | 15.3 | 3.5 | 13.4 | 19.5 | 19.4 |
| R1 | 9.59 | 0.00 | 0.00 | 20.52 | 17.36 | 5.33 | 7.23 | 5.79 | 23.87 | 10.22 |
| R2 | 5.42 | 0.0 | 0.0 | 21.5 | 18.2 | 5.6 | 7.6 | 6.1 | 25.0 | 10.7 |
| S1 | 9.69 | 0.00 | 0.99 | 11.56 | 0.00 | 26.55 | 14.54 | 36.76 | 0.00 | 0.00 |
| S2 | 5.42 | 0.0 | 1.0 | 12.1 | 0.0 | 27.8 | 15.2 | 38.5 | 0.0 | 0.0 |
| T | 9.66 | 0 | 0 | 13.5 | 15.3 | 4.2 | 15.4 | 12.3 | 26.6 | 3.3 |
| U | 9.66 | 0 | 0 | 4.2 | 12.8 | 15.7 | 7.5 | 32.2 | 0 | 17.9 |
| V | 9.81 | 0 | 0 | 19.1 | 13.3 | 0 | 0 | 17.2 | 26.8 | 13.7 |
| W | 9.67 | 0 | 0 | 0 | 32 | 11.8 | 26.7 | 19.7 | 0 | 0 |
| X | 9.65 | 0 | 0 | 9.7 | 0 | 0.4 | 0.73 | 34.5 | 24 | 21.1 |

Each of the gasoline-oxygenate blends was tested offline using the appropriate laboratory ASTM procedure found in the *Standard Test Method for Research Octane Number of Spark-Ignition Engine Fuel*, ASTM D 2699, the *Standard Test Method for Motor Octane Number of Spark-Ignition Engine Fuel*, ASTM D 2700, the *Standard Test Method for Vapor Pressure of Petroleum Products* (*Mini Method*), ASTM D 5191, and the *Standard Test Method for Distillation of Petroleum Products at Atmospheric Pressure*, ASTM D 86.

As before, each blend designation shown below corresponds to the gasoline-oxygenate blend recipe shown in Table 8. For example, gasoline-oxygenate blend A1 in Table 9 corresponds to the blend recipe shown for gasoline-oxygenate blend designation A1 in Table 8. Similarly, gasoline-oxygenate blend A2 below corresponds to the gasoline-oxygenate blend designation A2 in Table 8. With these designations in mind, the following gasoline-oxygenate blend properties were determined.

TABLE 9

PHASE I GASOLINE-OXYGENATE PROPERTIES

| Blend | RON | MON | (R + M)/2 | DVPE PSI | T10 ° F. | T50 ° F. | T90 ° F. | EP ° F. | E200 Vol. % | E300 Vol. % |
|---|---|---|---|---|---|---|---|---|---|---|
| A1 | 100.20 | 89.50 | 94.85 | 6.64 | 143.10 | 224.40 | 308.30 | 406.90 | 40.20 | 88.30 |
| A2 | 98.50 | 89.30 | 93.90 | 6.77 | 141.3 | 224.6 | 310.30 | 410.50 | 34.20 | 88.00 |
| B1 | 95.60 | 85.10 | 90.35 | 7.01 | 138.60 | 221.50 | 334.00 | 428.40 | 43.90 | 82.00 |
| B2 | 93.50 | 83.50 | 88.50 | 7.11 | 138.0 | 226.0 | 338.90 | 425.50 | 37.70 | 80.70 |
| C1 | 100.60 | 89.10 | 94.85 | 6.77 | 143.20 | 225.50 | 302.70 | 403.30 | 40.30 | 89.40 |
| C2 | 98.80 | 88.90 | 93.85 | 7.06 | 141.4 | 225.7 | 304.70 | 401.90 | 33.90 | 88.90 |
| D1 | 92.90 | 83.30 | 88.1 | 7.30 | 136.60 | 218.30 | 349.70 | 425.80 | 45.60 | 76.50 |
| D2 | 91.70 | 82.90 | 87.30 | 7.38 | 134.8 | 224.1 | 347.70 | 423.50 | 40.50 | 76.50 |
| E1 | 93.00 | 84.10 | 88.55 | 7.09 | 136.60 | 218.50 | 349.50 | 431.20 | 45.70 | 77.00 |
| E2 | 91.80 | 83.00 | 87.40 | 6.98 | 136.9 | 227.5 | 352.60 | 429.40 | 38.80 | 75.10 |
| F1 | 99.60 | 88.00 | 93.8 | 6.76 | 139.10 | 213.10 | 294.60 | 403.50 | 45.50 | 90.90 |
| F2 | 98.10 | 88.00 | 93.05 | 6.69 | 139.5 | 219.0 | 297.70 | 394.00 | 38.70 | 90.50 |
| G1 | 99.50 | 88.30 | 93.9 | 7.05 | 138.40 | 223.90 | 325.80 | 419.00 | 42.80 | 83.80 |
| G2 | 97.60 | 88.30 | 92.95 | 6.89 | 139.1 | 226.9 | 326.10 | 412.70 | 35.80 | 83.70 |
| H | 93.10 | 84.90 | 89 | 7.05 | 136.80 | 217.20 | 342.70 | 428.70 | 45.30 | 79.70 |
| I1 | 93.00 | 82.70 | 87.85 | 7.11 | 138.00 | 218.30 | 333.30 | 422.20 | 45.00 | 81.50 |
| I2 | 91.30 | 83.50 | 87.40 | 7.15 | 135.0 | 222.4 | 331.20 | 422.10 | 40.60 | 81.90 |
| J1 | 99.20 | 88.30 | 93.75 | 6.93 | 139.10 | 224.60 | 324.10 | 416.70 | 42.60 | 84.50 |
| J2 | 98.00 | 88.20 | 93.10 | 6.99 | 138.2 | 227.8 | 326.80 | 412.90 | 35.80 | 83.70 |
| K1 | 94.60 | 84.50 | 89.55 | 7.25 | 135.30 | 206.20 | 318.20 | 412.30 | 48.50 | 85.60 |
| K2 | 92.80 | 85.10 | 88.95 | 6.99 | 136.8 | 215.8 | 319.10 | 411.60 | 42.00 | 85.30 |
| L1 | 93.90 | 83.50 | 88.7 | 7.01 | 136.80 | 206.20 | 341.10 | 419.90 | 48.40 | 80.40 |
| L2 | 91.50 | 83.00 | 87.25 | 7.06 | 134.2 | 212.5 | 337.50 | 424.60 | 44.60 | 80.40 |
| M | 93.30 | 86.90 | 90.1 | 7.08 | 136.90 | 211.80 | 346.80 | 425.50 | 46.10 | 78.80 |
| N | 94.00 | 83.00 | 88.5 | 7.22 | 133.70 | 200.10 | 333.00 | 424.80 | 49.90 | 82.70 |
| O1 | 99.30 | 88.20 | 93.75 | 7.16 | 139.30 | 223.00 | 313.50 | 405.90 | 42.50 | 87.60 |
| O2 | 98.10 | 88.30 | 93.20 | 7.16 | 136.0 | 223.0 | 310.10 | 400.10 | 37.30 | 88.00 |
| P | 93.60 | 84.40 | 89 | 7.12 | 135.50 | 210.00 | 318.20 | 408.60 | 47.20 | 85.90 |
| Q | 93.50 | 84.80 | 89.15 | 7.06 | 137.50 | 219.60 | 345.00 | 422.80 | 45.20 | 79.80 |

TABLE 9-continued

PHASE I GASOLINE-OXYGENATE PROPERTIES

| Blend | RON | MON | (R + M)/2 | DVPE PSI | T10 ° F. | T50 ° F. | T90 ° F. | EP ° F. | E200 Vol. % | E300 Vol. % |
|---|---|---|---|---|---|---|---|---|---|---|
| Q2 | 92.10 | 83.20 | 87.65 | 7.14 | 135.9 | 224.1 | 344.10 | 423.70 | 40.00 | 79.20 |
| R1 | 93.00 | 83.00 | 88 | 7.32 | 136.40 | 214.30 | 335.70 | 413.20 | 46.50 | 79.60 |
| R2 | 90.60 | 83.00 | 86.80 | 7.28 | 135.7 | 222.8 | 340.00 | 419.40 | 40.80 | 79.00 |
| S1 | 99.20 | 88.20 | 93.7 | 7.16 | 138.40 | 208.40 | 275.50 | 369.50 | 47.00 | 93.80 |
| S2 | 97.70 | 88.40 | 93.05 | 7.22 | 138.7 | 213.1 | 276.40 | 369.30 | 40.90 | 94.00 |
| T | 93.00 | 84.10 | 88.55 | 7.02 | 139.10 | 224.80 | 339.60 | 416.10 | 43.40 | 78.80 |
| U | 98.40 | 87.80 | 93.1 | 7.05 | 139.80 | 218.80 | 314.20 | 410.90 | 43.60 | 87.40 |
| V | 92.00 | 84.00 | 88 | 7.12 | 137.70 | 219.70 | 340.00 | 416.50 | 44.70 | 79.20 |
| W | 99.20 | 88.20 | 93.7 | 7.16 | 138.40 | 208.40 | 275.50 | 369.50 | 47.00 | 93.80 |
| X | 92.00 | 84.00 | 88 | 7.12 | 137.70 | 219.70 | 340.00 | 416.50 | 44.70 | 79.20 |

Additional properties of the Phase I gasoline-oxygenate blends were determined using offline testing. The Oxygen ("Oxy") content was established by using the testing procedures found in *The Standard Test Method for Determination of MTBE, ETBE, TAME, DIPE, tertiary-Amyl Alcohol and $C_1$ to $C_4$ Alcohols in Gasoline by Gas Chromatography*, ASTM D 4815, and is expressed in weight percent. The Aromatics ("Arom") content was established by using the testing procedures found in *The Standard Test Method for Hydrocarbon Types in Liquid Petroleum Products by Fluorescent Indicator Adsorption*, ASTM D 1319, and is expressed volume percent. The Olefins ("Olef") content was established by using the testing procedures found in *The Standard Test Method for Hydrocarbon Types in Liquid Petroleum Products by Fluorescent Indicator Adsorption*, ASTM D 1319, and is expressed in volume percent. The Benzene ("Benz") content was established by using the testing procedures found in *The Standard Test Method for Determination of" Benzene and Toluene in Finished Motor and Aviation Gasoline by Gas Chromatography*, ASTM D 3606, and is expressed in volume percent. The sulfur ("Sulf") content was established by using the testing procedures found in *The Standard Test Method for Sulfur in Petroleum Products by Wavelength Dispersive X-Ray Fluorescence Spectrometry*, ASTM D 2622, and is expressed in parts per million by weight ("PPMW").

Additionally, the percentage reduction of NOx ("NOxR"), toxic pollutants ("ToxR"), and VOCs ("VOCR") were calculated using the Complex Model Phase I as prescribed by Federal Regulations, see, e.g., 40 C.F.R. §80.45 (1999), such that the positive value indicates the percentage amount that emissions were reduced. As before, the gasoline-oxygenate blend designations shown in Table 10 correspond to the gasoline-oxygenate blend designations in Tables 8-9. For example, the gasoline-oxygenate blend designation A1 corresponds to the gasoline-oxygenate blend designations shown in Tables 8-9 for gasoline-oxygenate blend A1. As previously discussed herein, each of these blend designation letters correspond to the neat blends shown in Table 6. The numerical designations following the letter designations are used to distinguish Phase I gasoline-oxygenate blends that have been prepared from the same neat blend. With these methods in mind, the following properties were found.

TABLE 10

ADDITIONAL PHASE I GASOLINE-OXYGENATE BLEND PROPERTIES

| Blend | Oxy Wt % | Benz Vol % | Sulfur PPMW | Olef Vol % | Arom Vol % | NOxR % Red | ToxR % Red | VOCR % Red |
|---|---|---|---|---|---|---|---|---|
| A1 | 3.54 | 0.53 | 23 | 1.41 | 23.25 | 15.7 | 40.4 | 47.5 |
| A2 | 2.02 | 0.55 | 24 | 1.47 | 24.30 | 15.8 | 39.5 | 43.9 |
| B1 | 3.49 | 0.58 | 197 | 2.90 | 25.01 | 7.2 | 34.5 | 39.5 |
| B2 | 1.99 | 0.61 | 206 | 3.03 | 26.14 | 7.1 | 33.1 | 35.9 |
| C1 | 3.47 | 0.53 | 34 | 2.31 | 33.89 | 13.5 | 35.2 | 44.6 |
| C2 | 1.98 | 0.55 | 36 | 2.41 | 35.41 | 13.1 | 32.7 | 37.8 |
| D1 | 3.56 | 0.71 | 80 | 3.68 | 23.75 | 12.1 | 33.4 | 33.8 |
| D2 | 2.03 | 0.75 | 84 | 3.85 | 24.83 | 12.0 | 32.8 | 31.1 |
| E1 | 3.58 | 0.68 | 143 | 1.92 | 24.34 | 9.3 | 33.2 | 37.4 |
| E2 | 2.04 | 0.71 | 149 | 2.01 | 25.43 | 9.4 | 32.6 | 37.2 |
| F1 | 3.48 | 0.63 | 70 | 4.61 | 32.97 | 11.4 | 34.3 | 45.6 |
| F2 | 1.99 | 0.66 | 73 | 4.82 | 34.46 | 11.7 | 32.3 | 45.6 |
| G1 | 3.46 | 0.67 | 36 | 2.10 | 25.73 | 14.1 | 36 | 39.8 |
| G2 | 1.97 | 0.70 | 38 | 2.20 | 26.89 | 14.4 | 35.4 | 41.3 |
| H | 3.55 | 0.52 | 261 | 4.30 | 16.76 | 7.5 | 36.8 | 39.3 |
| I1 | 3.52 | 0.70 | 68 | 3.08 | 31.08 | 11.5 | 32.1 | 37.8 |
| I2 | 2.01 | 0.73 | 71 | 3.21 | 32.48 | 11.6 | 30.9 | 36.1 |
| J1 | 3.53 | 0.85 | 83 | 3.79 | 28.20 | 11.5 | 31.8 | 41.7 |
| J2 | 2.01 | 0.89 | 87 | 3.96 | 29.47 | 11.6 | 29.9 | 39.0 |
| K1 | 3.54 | 1.05 | 106 | 2.38 | 24.83 | 10.5 | 29.9 | 36.6 |
| K2 | 2.02 | 1.10 | 111 | 2.49 | 25.95 | 10.6 | 29.3 | 40.4 |
| L1 | 3.45 | 0.69 | 108 | 2.82 | 27.83 | 9.9 | 33.6 | 39.9 |
| L2 | 1.99 | 0.72 | 113 | 2.94 | 29.06 | 9.7 | 32.7 | 38.2 |
| M | 3.50 | 0.77 | 215 | 4.70 | 26.14 | 6 | 30.3 | 37.6 |
| N | 3.51 | 0.78 | 247 | 7.39 | 31.62 | 3.2 | 27.1 | 35.6 |
| O1 | 3.59 | 0.64 | 116 | 3.99 | 28.50 | 9.9 | 33.8 | 37.5 |
| O2 | 1.99 | 0.67 | 122 | 4.18 | 29.88 | 9.8 | 32.4 | 36.4 |
| P | 3.56 | 0.51 | 213 | 3.06 | 25.15 | 6.2 | 35.8 | 38.3 |

TABLE 10-continued

ADDITIONAL PHASE I GASOLINE-OXYGENATE BLEND PROPERTIES

| Blend | Oxy Wt % | Benz Vol % | Sulfur PPMW | Olef Vol % | Arom Vol % | NOxR % Red | ToxR % Red | VOCR % Red |
|---|---|---|---|---|---|---|---|---|
| Q1 | 3.50 | 0.69 | 260 | 1.15 | 30.83 | 3.9 | 28.2 | 36.7 |
| Q2 | 1.97 | 0.73 | 272 | 1.21 | 32.27 | 3.7 | 26.3 | 33.6 |
| R1 | 3.54 | 0.85 | 177 | 4.55 | 27.11 | 7.1 | 28.8 | 33.3 |
| R2 | 2.00 | 0.89 | 185 | 4.76 | 28.36 | 7.1 | 27.5 | 32.6 |
| S1 | 3.59 | 0.56 | 88 | 4.20 | 23.60 | 11.8 | 39.1 | 38.7 |
| S2 | 2.01 | 0.59 | 92 | 4.40 | 24.71 | 11.8 | 37.7 | 36.5 |
| T | 3.54 | 0.73 | 128 | 2.11 | 28.15 | 9.3 | 31.4 | 38.3 |
| U | 3.54 | 0.49 | 250 | 4.86 | 25.18 | 5.3 | 35.3 | 39.2 |
| V | 3.61 | 0.64 | 177 | 3.32 | 22.57 | 8.4 | 34.1 | 37.4 |
| W | 3.50 | 0.81 | 110 | 5.41 | 33.39 | 9.1 | 29.9 | 38.3 |
| X | 3.58 | 0.27 | 286 | 5.92 | 32.65 | 2.7 | 32.4 | 35.2 |

Turning to the blends made after 1999, herein referred to as Phase II, the following neat blends recipes were formulated using the same method.

TABLE 11

PHASE II NEAT BLEND RECIPES

| BLEND | C4 | FFB | RAFF | HOR | TOL | LCC | ALKY | LSCC | HCC |
|---|---|---|---|---|---|---|---|---|---|
| | (in terms of volume percent of the total blend) (%) | | | | | | | | |
| AA | 0.0 | 4.5 | 14.7 | 15.5 | 26.6 | 0.0 | 38.7 | 0.0 | 0.0 |
| BB | 0.0 | 0.0 | 20.2 | 19.5 | 0.0 | 20.8 | 15.2 | 21.9 | 2.5 |
| CC | 0.0 | 0.0 | 18.2 | 33.5 | 0.2 | 0.0 | 27.2 | 1.6 | 19.2 |
| DD | 0.0 | 1.7 | 0.1 | 12.8 | 18.2 | 21.7 | 38.9 | 6.7 | 0.0 |
| EE | 0.0 | 0.2 | 2.4 | 2.3 | 27.4 | 25.3 | 40.4 | 2.0 | 0.0 |
| FF | 0.4 | 0.0 | 22.8 | 33.8 | 0.0 | 1.7 | 17.7 | 8.8 | 14.8 |
| GG | 0.0 | 4.9 | 7.1 | 17.4 | 38.9 | 18.1 | 13.6 | 0.0 | 0.0 |
| HH | 0.9 | 0.2 | 23.5 | 40.7 | 0.2 | 4.6 | 5.3 | 14.6 | 9.9 |
| II | 0.0 | 2.2 | 3.2 | 38.7 | 13.7 | 16.8 | 24.0 | 0.0 | 1.4 |
| JJ | 0.0 | 0.0 | 27.9 | 0.1 | 20.6 | 16.6 | 13.6 | 21.2 | 0.0 |
| KK | 0.0 | 0.7 | 5.9 | 4.6 | 31.6 | 22.3 | 35.0 | 0.0 | 0.0 |

These neat blends were similarly tested online using certified online analyzers calibrated to ASTM standards and methods. The following Table 12 includes neat blend properties wherein each neat blend, designated by a letter designation AA-KK, corresponds to the same letter designation AA-KK from Table 11. With this correspondence in mind, the Phase II neat blends had the following properties prior to the introduction of oxygenates.

As before, oxygenates were introduced via an oxygenate unit 14 in a line 52. To each of these blends, oxygenates were introduced such that the oxygenates of the blend comprised less than or equal to about ten (10) volume percent. Each of the gasoline-oxygenate blends contained denatured ethanol meeting ASTM D 4806 as the oxygenate.

The following Table 13, entitled "Phase II Gasoline-Oxygenate Blend Recipes," shows a series of recipes relating to gasoline-oxygenate blends after the introduction of at least one oxygenate to the corresponding neat blends previously shown in Tables 11-12. Of note, some of the neat blends AA-KK were used in the formulation of at least two gasoline-oxygenate blends. For example, neat blend D shown in Tables 11-12 was blended with ethanol to form a gasoline-oxygenate blend DD1 wherein the ethanol was about 9.750 volume percent and gasoline-oxygenate blend DD2 wherein the ethanol content was about 5.42 volume percent. Therefore, the gasoline-oxygenate blends DD1 and DD2 represent variations in the introduction of oxygenates to neat blend DD. The gasoline-oxygenate Phase II blend recipes shown in Table 13 are arranged such that the corresponding neat blend letter relates to the corresponding blend letter shown in Table 11-12. Similarly, the Phase II gasoline-oxygenate blend properties shown in Tables 14-15 correspond to the blend letter designations, and number designation, if applicable. Accordingly, Table 13, entitled "Phase II Gasoline-Oxygenate Blend Recipes," shows each gasoline-oxygenate blend recipe in terms of volume percent of the total blend after the introduction of oxygenates.

TABLE 12

PHASE II NEAT BLEND RECIPES PROPERTIES

| Blend | RON | MON | (R + M)/2 | DVPE PSI | T10 ° F. | T50 ° F. | T90 ° F. | EP ° F. | E200 Vol. % | E300 Vol. % |
|---|---|---|---|---|---|---|---|---|---|---|
| AA | 96.5 | 87.5 | 92.0 | 5.5 | 156.3 | 224.5 | 308.5 | 387.0 | 30.5 | 88.0 |
| BB | 88.1 | 81.9 | 85.0 | 5.3 | 145.4 | 213.7 | 342.0 | 415.5 | 42.9 | 79.1 |
| CC | 90.7 | 83.6 | 87.2 | 5.3 | 150.6 | 214.7 | 327.7 | 406.2 | 40.0 | 83.1 |
| DD | 96.3 | 87.7 | 92.0 | 5.5 | 151.4 | 222.6 | 308.3 | 398.3 | 33.1 | 88.1 |
| EE | 96.6 | 87.9 | 92.3 | 5.5 | 159.0 | 217.1 | 277.0 | 375.7 | 33.9 | 92.1 |
| FF | 89.8 | 82.5 | 86.2 | 5.5 | 145.9 | 218.4 | 336.0 | 414.6 | 40.2 | 79.9 |
| GG | 97.2 | 86.8 | 92.0 | 5.5 | 153.8 | 228.1 | 303.9 | 386.3 | 29.9 | 88.8 |
| HH | 89.0 | 81.8 | 85.4 | 5.5 | 146.3 | 231.5 | 340.8 | 416.3 | 36.9 | 75.1 |
| II | 96.4 | 87.2 | 91.8 | 5.5 | 152.7 | 231.4 | 323.4 | 393.0 | 30.3 | 83.2 |
| JJ | 88.4 | 81.9 | 85.2 | 5.4 | 150.1 | 213.0 | 322.6 | 414.5 | 41.1 | 85.4 |
| KK | 96.6 | 87.0 | 91.8 | 5.4 | 159.9 | 218.4 | 281.2 | 374.0 | 32.8 | 92.1 |

TABLE 13

PHASE II GASOLINE-OXYGENATE BLEND RECIPES

| BLEND | EtOH | C4 | FFB | RAFF | HOR | TOL | LCC | ALKY | LSCC | HCC |
|---|---|---|---|---|---|---|---|---|---|---|
| | (in terms of volume percent of the total blend) (%) | | | | | | | | | |
| AA | 9.750 | 0.0 | 4.1 | 13.3 | 14.0 | 24.0 | 0.0 | 34.9 | 0.0 | 0.0 |
| BB | 9.900 | 0.0 | 0.0 | 18.2 | 17.6 | 0.0 | 18.7 | 13.7 | 19.7 | 2.3 |
| CC | 9.680 | 0.0 | 0.0 | 16.4 | 30.3 | 0.2 | 0.0 | 24.6 | 1.4 | 17.3 |
| DD1 | 9.610 | 0.0 | 1.5 | 0.1 | 11.6 | 16.5 | 19.6 | 35.2 | 6.1 | 0.0 |
| DD2 | 5.420 | 0.0 | 1.6 | 0.1 | 12.1 | 17.2 | 20.5 | 36.8 | 6.3 | 0.0 |
| EE1 | 9.450 | 0.0 | 0.2 | 2.2 | 2.1 | 24.8 | 22.9 | 36.6 | 1.8 | 0.0 |
| EE2 | 5.420 | 0.0 | 0.2 | 2.3 | 2.2 | 25.9 | 23.9 | 38.2 | 1.9 | 0.0 |
| FF | 9.640 | 0.4 | 0.0 | 20.6 | 30.5 | 0.0 | 1.5 | 16.0 | 8.0 | 13.4 |
| GG | 9.560 | 0.0 | 4.4 | 6.4 | 15.7 | 35.2 | 16.4 | 12.3 | 0.0 | 0.0 |
| HH | 9.910 | 0.8 | 0.2 | 21.2 | 36.7 | 0.2 | 4.1 | 4.8 | 13.2 | 8.9 |
| II | 9.760 | 0.0 | 2.0 | 2.9 | 34.9 | 12.4 | 15.2 | 21.7 | 0.0 | 1.3 |
| JJ | 9.660 | 0.0 | 0.0 | 25.2 | 0.1 | 18.6 | 15.0 | 12.3 | 19.2 | 0.0 |
| KK1 | 9.620 | 0.0 | 0.6 | 5.3 | 4.2 | 28.6 | 20.2 | 31.6 | 0.0 | 0.0 |
| KK2 | 5.420 | 0.0 | 0.7 | 5.6 | 4.4 | 29.9 | 21.1 | 33.1 | 0.0 | 0.0 |

Using the laboratory ASTM testing procedures (found in ASTM D 2699, ASTM D 2700, ASTM D 5191, and ASTM D 86), each of the gasoline-oxygenate blends was tested offline using the appropriate ASTM procedure previously discussed herein. As before, each gasoline-oxygenate blend designation in Tables 14-15 correspond to the gasoline-oxygenate blend recipe shown in Table 13. The following Phase II gasoline-oxygenate blend properties were determined.

TABLE 14

PHASE II GASOLINE-OXYGENATE BLEND PROPERTIES

| Blend | RON | MON | (R + M)/2 | DVPE PSI | T10 ° F. | T50 ° F. | T90 ° F. | EP ° F. | E200 Vol. % | E300 Vol. % |
|---|---|---|---|---|---|---|---|---|---|---|
| AA | 99.10 | 88.70 | 93.90 | 6.79 | 141.6 | 219.9 | 300.00 | 386.40 | 42.10 | 90.00 |
| BB | 93.00 | 84.30 | 88.65 | 7.01 | 134.1 | 195.1 | 332.80 | 397.80 | 51.00 | 81.50 |
| CC | 95.00 | 86.10 | 90.55 | 6.80 | 137.7 | 207.7 | 325.20 | 397.00 | 47.70 | 84.50 |
| DD1 | 99.00 | 88.50 | 93.75 | 6.76 | 140.0 | 218.7 | 304.30 | 385.90 | 43.70 | 89.30 |
| DD2 | 97.40 | 87.30 | 92.35 | 6.77 | 138.7 | 220.8 | 304.70 | 398.80 | 38.00 | 89.10 |
| EE1 | 99.40 | 88.80 | 94.10 | 6.77 | 139.1 | 209.1 | 272.50 | 361.80 | 46.60 | 93.70 |
| EE2 | 98.20 | 88.10 | 93.15 | 6.78 | 139.5 | 212.7 | 309.20 | 374.00 | 41.00 | 93.90 |
| FF | 93.80 | 84.80 | 89.30 | 6.80 | 136.0 | 208.0 | 334.40 | 401.90 | 48.00 | 81.60 |
| GG | 99.30 | 87.60 | 93.45 | 6.80 | 140.7 | 222.8 | 304.70 | 382.80 | 42.80 | 89.00 |
| HH | 93.20 | 83.40 | 88.30 | 6.77 | 138.6 | 223.0 | 340.00 | 370.80 | 44.90 | 74.90 |
| II | 99.00 | 88.20 | 93.60 | 6.69 | 140.4 | 227.1 | 318.90 | 395.10 | 41.50 | 84.80 |
| JJ | 93.40 | 83.70 | 88.55 | 6.69 | 141.1 | 210.2 | 273.40 | 361.80 | 45.70 | 94.00 |
| KK1 | 99.10 | 88.20 | 93.65 | 6.67 | 140.7 | 211.8 | 279.70 | 368.10 | 45.50 | 93.10 |
| KK2 | 97.70 | 87.90 | 92.80 | 6.57 | 140.7 | 215.4 | 282.60 | 370.00 | 38.70 | 92.70 |

Additional properties of the Phase II gasoline-oxygenate blends were determined using ASTM Standards and Methods as discussed herein. Of note, the percentage reduction of NOx ("NOxR"), toxic pollutants ("ToxR"), and VOCs ("VOCR") were calculated using the Complex Model Phase II as prescribed by Federal Regulations, see, e.g., 40 C.F.R. §80.45 (1999), such that the positive value indicates the percentage amount that emissions were reduced.

TABLE 15

ADDITIONAL PHASE II GASOLINE-OXYGENATE PROPERTIES

| Blend | Oxy Wt % | Benz Vol % | Sulfur PPMW | Olef Vol % | Arom Vol % | NOxR % Red | ToxR % Red | VOCR % Red |
|---|---|---|---|---|---|---|---|---|
| AA | 3.57 | 0.38 | 26 | 1.57 | 25.58 | 14.6 | 34.1 | 27.7 |
| BB | 3.65 | 0.65 | 94 | 4.65 | 23.68 | 10.9 | 30.1 | 26.9 |
| CC | 3.60 | 0.69 | 190 | 3.00 | 23.67 | 7.5 | 28.3 | 27.5 |

TABLE 15-continued

ADDITIONAL PHASE II GASOLINE-OXYGENATE PROPERTIES

| Blend | Oxy Wt % | Benz Vol % | Sulfur PPMW | Olef Vol % | Arom Vol % | NOxR % Red | ToxR % Red | VOCR % Red |
|---|---|---|---|---|---|---|---|---|
| DD1 | 3.55 | 0.43 | 75 | 4.32 | 24.73 | 12.4 | 33.1 | 28.4 |
| DD2 | 2.01 | 0.48 | 76 | 4.52 | 25.88 | 12.4 | 31.5 | 26.4 |
| EE1 | 3.52 | 0.40 | 100 | 4.94 | 22.74 | 11.7 | 34.7 | 29.1 |

TABLE 15-continued

ADDITIONAL PHASE II GASOLINE-OXYGENATE PROPERTIES

| Blend | Oxy Wt % | Benz Vol % | Sulfur PPMW | Olef Vol % | Arom Vol % | NOxR % Red | ToxR % Red | VOCR % Red |
|---|---|---|---|---|---|---|---|---|
| EE2 | 2.03 | 0.41 | 104 | 5.16 | 23.76 | 11.6 | 33.5 | 27.3 |
| FF | 3.54 | 0.71 | 155 | 3.91 | 24.56 | 8.5 | 27.9 | 27.1 |
| GG | 3.43 | 0.61 | 85 | 3.46 | 37.73 | 10.6 | 23.6 | 26.2 |
| HH | 3.58 | 0.76 | 119 | 3.93 | 32.40 | 8.6 | 22.2 | 20.8 |
| II | 3.52 | 0.65 | 67 | 2.80 | 32.32 | 11.6 | 26.3 | 26.4 |
| JJ | 3.56 | 0.45 | 71 | 3.49 | 28.36 | 11.9 | 32.1 | 28.9 |
| KK1 | 3.53 | 0.49 | 86 | 4.16 | 27.63 | 11.4 | 31.6 | 29.0 |
| KK2 | 2.01 | 0.51 | 90 | 4.35 | 28.91 | 11.4 | 29.6 | 27.5 |

As the results of these tests show, the inclusion of oxygenates such as ethanol, provides gasoline-oxygenate blends that produce a relatively low amount of gaseous pollutants with the reduction or elimination of MTBE as a fuel additive. Though the efforts shown above attempted to reduce or significantly eliminate the introduction of MTBE, those skilled in the art recognize that trace amount of MTBE and similar ethers may be introduced during the blending process. Certain blending agents or constituents may contain ether. The present invention benefits from reducing the introduction of MTBE into the resulting gasoline-oxygenate blends.

The blending of at least two hydrocarbon streams may produce gasoline-oxygenate blends having these desirable properties as well as low temperature and volatility. As the preferred embodiment shows, this gasoline-oxygenate blend successfully includes at least one alcohol, such as ethanol, while reducing pollution. With regard to the calculation of percentage of reduction of NOx, toxic pollutants, and/or VOCs, the mathematical models found in 40 C.F.R. §80.45 (1999) for Phase II Complex Model are currently more appropriate. Those skilled in the art will recognize that future regulations may alter, further restrict, or effectuate additional calculations for any of those properties including but not limited to the percentage reduction of these and other pollutants. Accordingly, nothing herein is intended to limit the scope of this disclosure or the claims.

Moreover, those skilled in the art will recognize that this disclosure has focused on rules, regulations, and requirements with regard to EPA Region 1. Though the inventive concepts are clearly demonstrated in EPA Region 1, there is no limitation to the scope of the disclosure or claims such that it is only applicable to EPA Region 1. The inventive concepts disclosed and claimed herein are applicable to any environment that may benefit from the invention.

Future regulations may even be more restrictive than the requirements outlined in the Complex Model Phase II, Region 1 presented in 40 C.F.R. §80.45 (1999). Those skilled in the art recognize the inventive concepts as disclosed and claimed herein are made with reference to the Complex Model Phase II presented in 40 C.F.R. §80.45 (1999), but that the inventive concepts as disclosed and claimed herein are equally applicable to future and possibly more restrictive regulations that may be promulgated.

Finally, though the preferred embodiment as depicted herein represents an embodiment of the invention should allow for the flexibility and versatility for embodiments not described or depicted herein, those skilled in the art will realize its significant variation and deviations from this embodiment are meant to be within the scope of this invention.

What is claimed is:

1. A gasoline-oxygenate blend, suitable for combustion in an automotive engine, comprising at least two hydrocarbon streams and an oxygenate stream consisting essentially of an alcohol and having:

a Dry Vapor Pressure Equivalent less than about 7.2 PSI; and an alcohol content greater than about 5.0 volume percent.

2. The blend of claim 1 wherein the blend has a 50% distillation point less than about 178° F.

3. The blend of claim 1 wherein the blend has a 10% distillation point less than about 123° F.

4. The blend of claim 1 wherein the blend has an anti-knock index greater than about 89.

5. The blend of claim 1 wherein the blend is capable of reducing toxic air pollutants emissions by more than about 21.5%.

6. The blend of claim 1 wherein the blend has an oxygen weight percent that is greater than about 1.8 weight percent.

7. The blend of claim 1 wherein the oxygenate stream contains ethanol.

8. A process for preparing a gasoline-oxygenate blend comprising combining a blend of hydrocarbons with a stream consisting essentially of an alcohol, wherein the resulting gasoline-oxygenate blend has the following properties:

(a) a Dry Vapor Pressure Equivalent less than about 7.2 PSI; and (b) an alcohol content greater than about 5.0 volume percent.

9. The process of claim 8 wherein the alcohol is ethanol.

10. The process of claim 8 wherein the resulting blend contains essentially no methyl t-butyl ether.

* * * * *